US007156326B1

(12) United States Patent
Chou

(10) Patent No.: US 7,156,326 B1
(45) Date of Patent: Jan. 2, 2007

(54) WATER SPRAYER WITH WATER-SPRAYING ADJUSTMENT MECHANISM

(75) Inventor: Tsung Min Chou, Taipei (TW)

(73) Assignee: Plastico Corp., Taipei (TW)

( * ) Notice: Subject to any disclaimer, the term of this patent is extended or adjusted under 35 U.S.C. 154(b) by 0 days.

(21) Appl. No.: 11/412,833

(22) Filed: Apr. 28, 2006

(51) Int. Cl.
*B05B 15/00* (2006.01)

(52) U.S. Cl. ..... 239/542; 239/452; 239/457; 239/456; 239/460; 239/600; 239/547; 239/569

(58) Field of Classification Search ..... 239/542, 239/547, 452, 453, 456, 457, 458, 460, 600, 239/538, 539; 137/513.5, 877; 251/117
See application file for complete search history.

(56) References Cited

U.S. PATENT DOCUMENTS 4,998,562 A * 3/1991 Foltz ..... 137/877
5,004,161 A * 4/1991 Antel ..... 239/542

* cited by examiner

*Primary Examiner*—Dinh Q. Nguyen
(74) *Attorney, Agent, or Firm*—Rosenberg, Klein & Lee

(57) ABSTRACT

A water sprayer with a water spraying adjustment mechanism including a body and a rotatable cap is disclosed. The body includes an outer tubular wall with a threaded outer surface forming a central axial bore extrusion defining an inner chamber, an inner tubular wall within the inner chamber coaxially distributed with the outer tubular wall and constructed with a plurality of slotted grooves defining a plurality of grooved water runners, and an inlet portion being adapted to connect a source of pressurized water. The rotatable cap includes an inner tubular wall with an inner surface blocked around the grooved water runners, an outer tubular wall threaded on the outer tubular wall of the body for sealing the annular inner chamber, and a plurality of water outlets formed on the outer tubular wall of the rotatable cap and communicating with the grooved water runners for water spraying. When the rotatable cap is rotated, the blocking condition between its inner tubular wall and the grooved water runners is changed to achieve an adjustment of water spraying rate.

5 Claims, 9 Drawing Sheets

WATER SPRAYER WITH WATER-SPRAYING ADJUSTMENT MECHANISM

FIELD OF THE INVENTION

The present invention relates to a water sprayer, and more particularly to a water sprayer provided with an adjustment mechanism for adjusting water-spraying rate thereof.

BACKGROUND OF THE INVENTION

Miniature watering devices, whether being provided in the form dripper, nozzle, sprayer or others, are widely used for controlling water flowing rate of water to gardens or garden plants. Thus, many kinds of miniature watering devices are provided with a specified mechanism able to adjust various degree of cross-area being available for water flowing, so that the flow rate of water can be controlled.

However, for the most miniature watering devices manufactured in prior art, a number of problems had been presented for many years. One obvious problem as known by people is that the water flow passageways may be blocked and clogged due to the reason that the grit or other foreign particles are accumulated within the water flow passageways. Another problem is when the water passageways within the miniature watering device, the grit or other foreign particles are not easy to be clean. Moreover, a further problem is individual units cannot accurately adjust the rate of water flow step by step.

SUMMARY OF THE INVENTION

Since the existed disadvantages of the conventional miniature watering device as we known as above has brought many inconveniences and troubles for many people in daily life, it will be more necessary for us to search for some method to solve these problems. Under the situation as above description, a primary object of the present invention is to provide a water sprayer fitted with an adjustment mechanism by which can generate adjustable and homogeneous spraying water to the gardens or plants.

A secondary object of the present invention is to provide a water sprayer fitted with an adjustment mechanism that can bring more convenience when people need to clean the water sprayer.

The water sprayer used to solve above problems is mainly composed of a body with generally cylindrical construction and a rotatable cap being adapted to thread on the body. The body includes an outer tubular, an inner tubular wall, and an inlet portion. The outer tubular wall with a threaded outer surface forms a central axial bore extrusion to define an inner chamber. The inner tubular wall within the annular inner chamber is coaxially distributed with the outer tubular wall and constructed with a plurality of slotted grooves to define a central water runner and a plurality of grooved water runners formed around the central water runner for communicating with the central water runner. The inlet portion is adapted to connect a source of pressurized water to define an inlet water runner communicating with the central water runner.

The rotatable cap is adapted to thread on the body and includes an inner tubular, an outer tubular wall and a plurality of water outlets. The wall with an inner surface is blocked around the grooved water runners. The outer tubular wall with a threaded inner surface is fit for and in cooperation with the threaded outer surface of the outer tubular wall of the body for sealing the inner chamber. The water outlets are formed on the outer tubular wall of the rotatable cap and communicating with the grooved water runners for water spraying.

When the rotatable cap is rotated from a condition that the inner tubular wall of the rotatable cap is fully covered or blocked around the grooved water runners to anther condition that the inner tubular wall of the rotatable cap is approximately blocked less around the grooved water runners, a rate of water spraying at the water outlets is synchronously increased from zero to its greatest limitation to achieve an adjustment of water spraying rate.

Due to the reason that the adjustment mechanism and the passageways of water flow are only combined in two simple integrated parts, i.e. the body and the rotatable cap, and the rotatable cap is connected to the body by threading, so that people can easily remove the rotatable cap from the body through rotating the rotatable cap and clean the body and the rotatable cap in convenient ways.

By the way, a plurality of circularly distributed co-ratcheted mechanisms fit for the outer surface of the inner tubular of the body is formed in the inner surface of the inner tubular wall of the rotatable cap, so that the step-by-step accurate adjustment of water spraying can be achieved.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The construction, devices, characteristics and the best embodiment of this invention are described with relative figures as follows.

Figure 1:
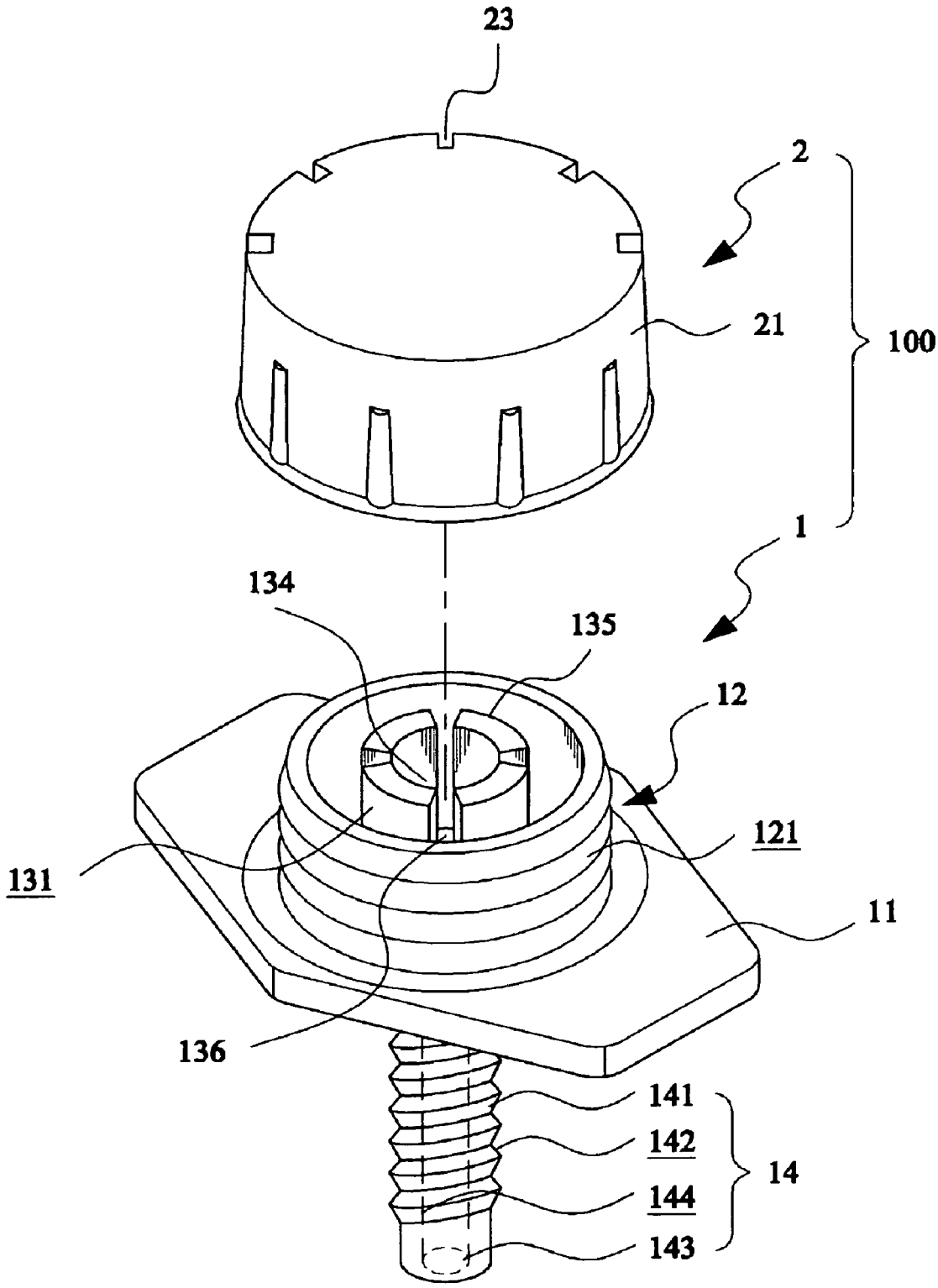
FIG. 1 is a perspective view of a water sprayer in accordance with a first embodiment of the present invention showing the water sprayer comprises a body and a rotatable cap.

Please refer to FIG. 1, which present a perspective view of a water sprayer in accordance with a best embodiment of the present invention. A water sprayer 100 in accordance with the best embodiment of this invention comprises a body 1 and a rotatable cap 2.

Figure 2:
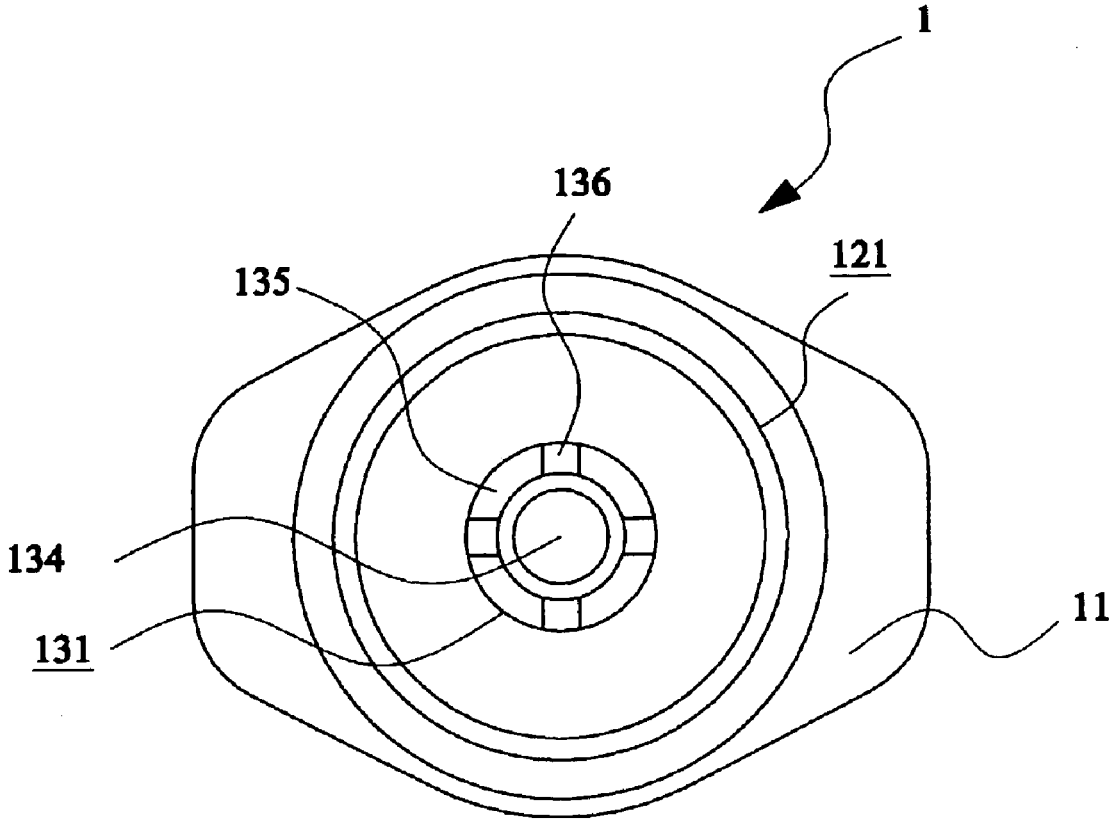
FIG. 2 is a top view of the body in accordance with the first embodiment of the present invention.

Please refer to FIG. 2 presenting a top view of the body in accordance with the first embodiment of the present invention, and also refer to FIG. 1 (and FIG. 4) at the same time. The body 1 is formed in a generally cylindrical construction and including a baseboard 11, an outer tubular wall 12, an inner tubular wall 13 and an inlet portion 14. The baseboard 11 is provided as a base of the body 1. The outer tubular wall 12 is provided with a threaded outer surface 121 and circularly extruded from the baseboard 11. The inner tubular wall 13 with an outer surface 131 within the outer tubular wall comprises a base section 132 and a grooved section 133. The base section 132 is circularly extruded from the baseboard 11 coaxial with the outer tubular wall 12 and defining a central runner 134. The grooved section 133 with a terminate edge 135 extended from the base section 132 to the terminate edge 135 and constructed with a plurality of slotted grooves 136 extended from the terminate edge 135 toward the base section 132. The grooved section 133 defines a plurality of grooved runners 136 through the inner tubular wall 13, and the grooved runners 136 communicates with the central runner 134.

The inlet portion 14 is adapted to connect a source of pressurized water (not shown in the figures), and constructed in a tubular stem 141. A threaded outer surface 142 is formed on the tubular stem 141, so that the body 1 can be threaded on the source of pressurized water. An inlet runner 143 is formed in an inner surface 144 of the tubular stem 141 and communicating with the central water runner 134.

Figure 3:
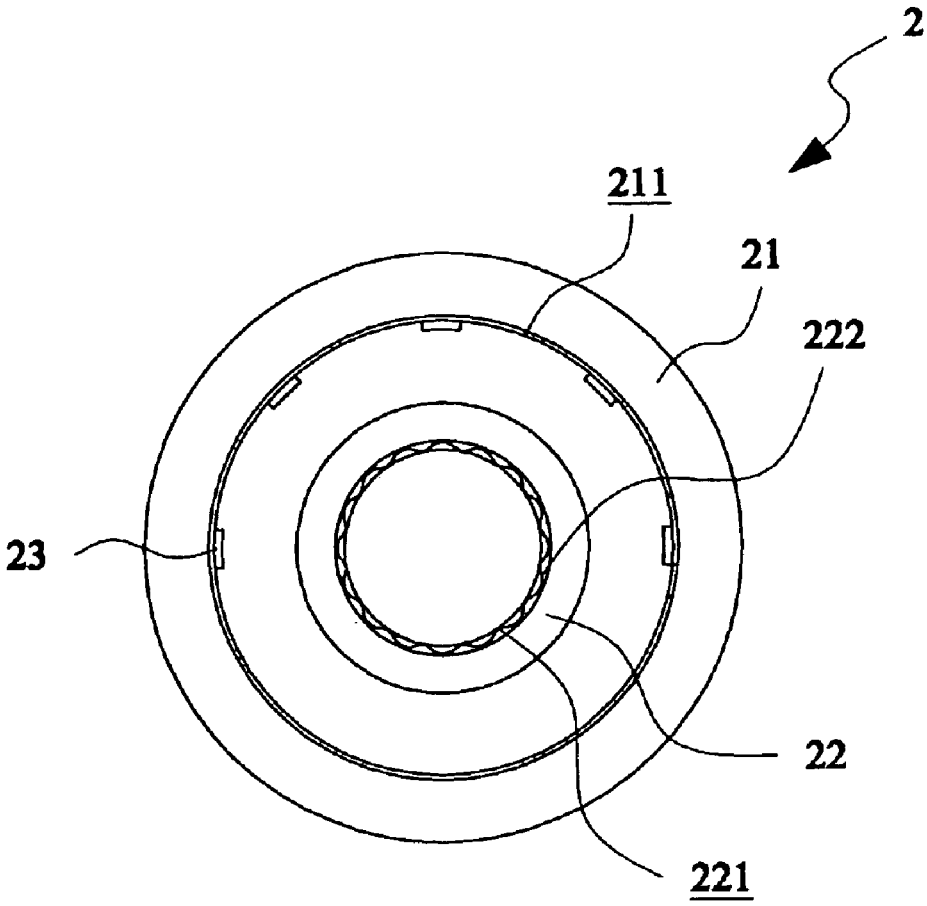
FIG. 3 is a bottom view of the rotatable cap in accordance with the first embodiment of the present invention.
Figure 4:
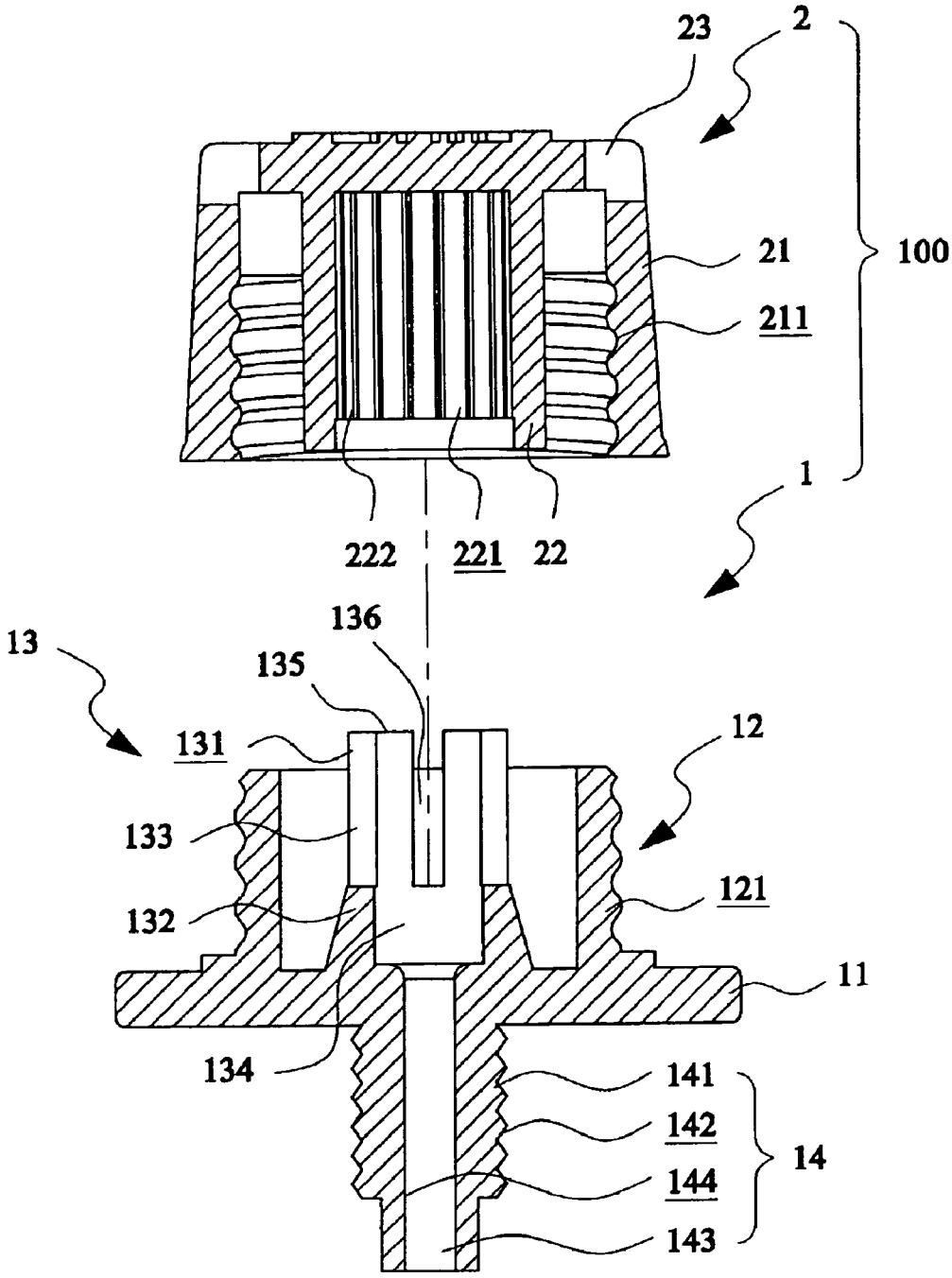
FIG. 4 is a sectional view of the arrangement of co-ratcheted mechanisms and the threaded face between the body and the rotatable cap when the rotatable cap is removed from the body.

Please refer to FIG. 3, which presets a bottom view of the rotatable cap in accordance with the first embodiment of the present invention. The rotatable cap 2 is adapted to thread on the body 1 and including an outer tubular wall 21, an inner tubular wall 22 and a plurality of water outlets 23. The outer tubular wall 21 has a threaded inner surface 211 fit for the threaded outer surface 121 of the outer tubular wall 12 of the body 1 in dimension. The inner tubular wall 22 is provided with an inner surface 221 in a dimension with respect to the inner tubular wall 13 of the body 1. A plurality of circularly distributed co-ratcheted mechanisms 222 fit for the outer surface 121 of the inner tubular wall 13 of the body 1 is formed on the inner surface 221 of the inner tubular wall 22 (as shown in FIG. 4). The water outlets 23 formed on the specified position of the outer tubular wall 21 of the rotatable cap 2.

Figure 5:
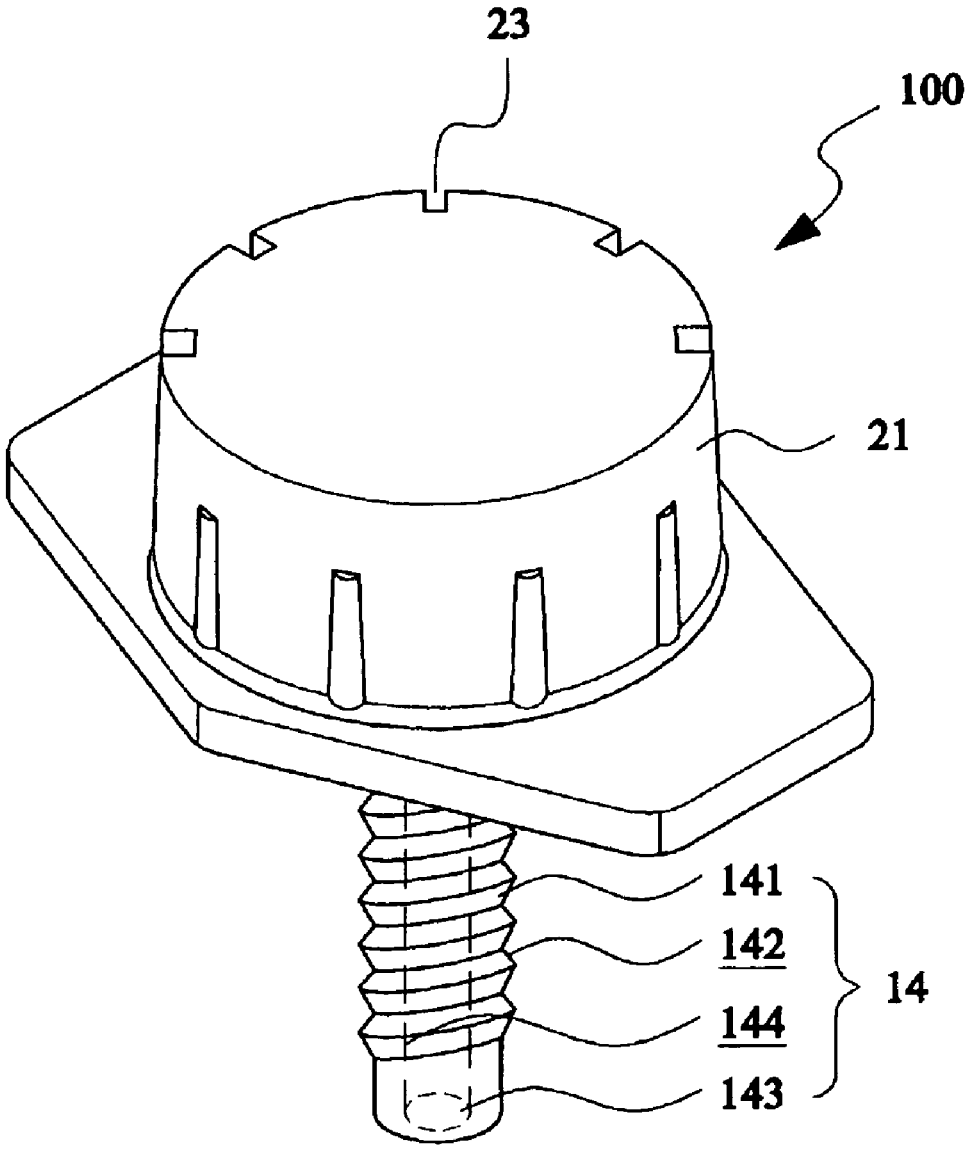
FIG. 5 is a perspective view of the water sprayer in accordance with the first embodiment of the present invention showing the rotatable cap is assembled with the body in an initial state.
Figure 6:
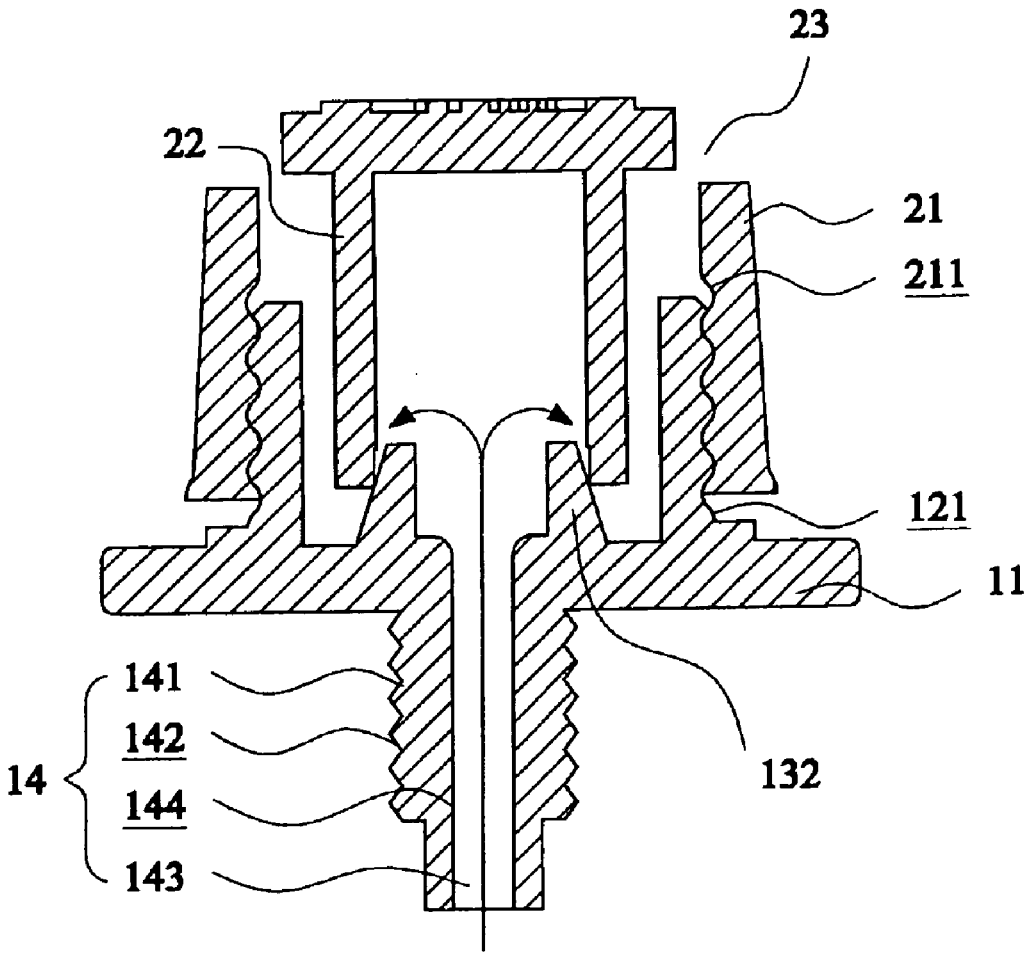
FIG. 6 is a section view of the water sprayer in accordance with the first embodiment of the present invention, which shows water within grooved water runners being fully blocked by an inner tubular wall of the rotatable cap in the initial state.

Please refer to FIG. 4 to FIG. 6. Due to the reason that the dimension of the threaded inner surface 211 of the outer tubular wall 21 of rotatable cap 2 is fit for that of the threaded outer surface 121 of the outer tubular wall 12 of the body 1, the rotatable cap 2 can be connected to the body 1 via the connection between the thread inner surface 211 of the outer tubular wall 21 and the threaded outer surface 121 of the outer tubular wall 12 to from the water sprayer 100. When the water sprayer 100 connect the source of pressurized water (not shown in the figures) and the rotatable cap 2 is in a condition that the inner tubular wall 22 of the rotatable cap 2 is fully blocked around the grooved runners 136, i.e. the inner tubular wall 22 circularly seals the outer surface 131 or circularly touches the base section of the base section 132, water can flow from the source of pressurized water, pass through the inlet runner 143 and the central water runner 134, but it will be blocked by the inner tubular wall 22 of the rotatable cap 2. The water flowing path is shown in the arrow line.

Figure 7:
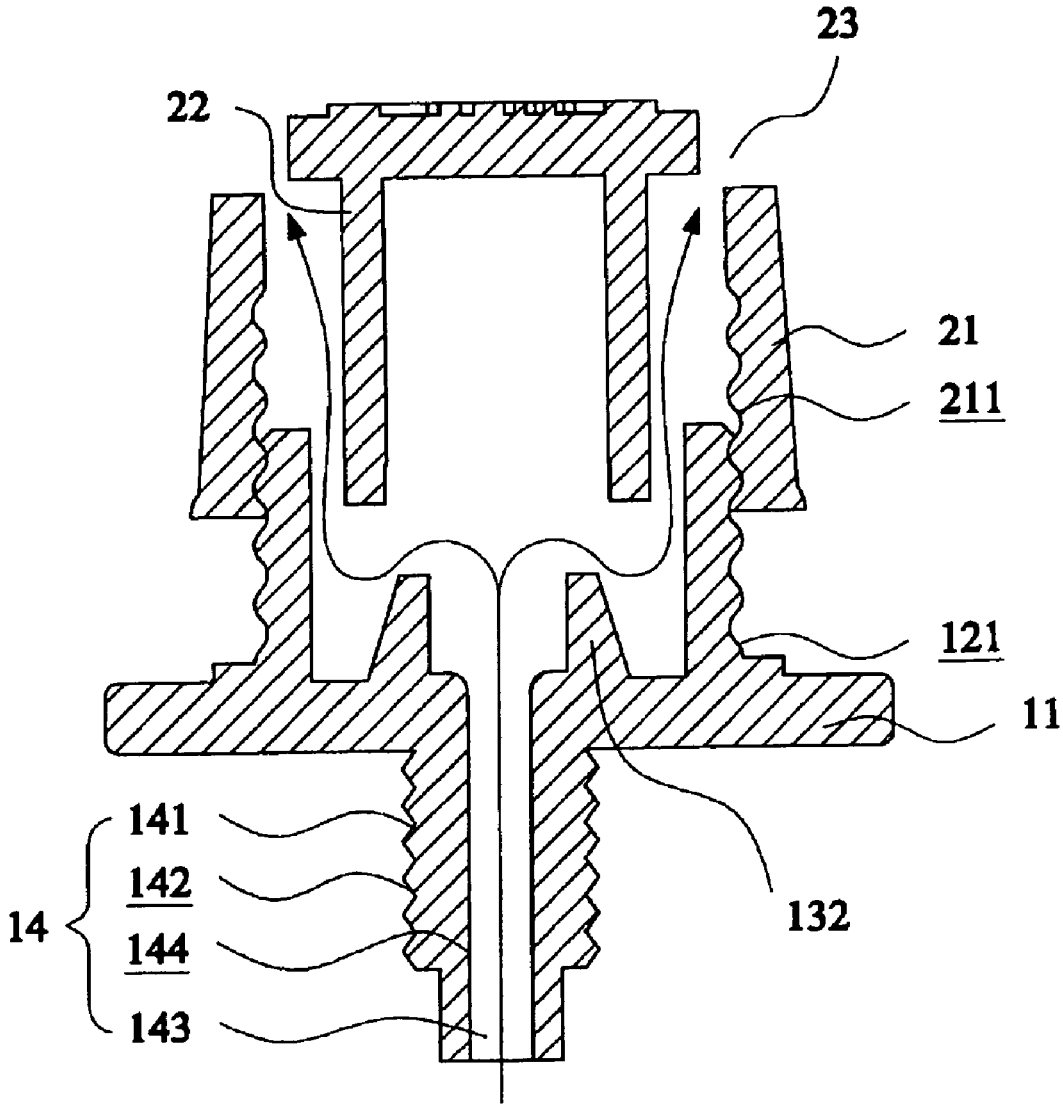
FIG. 7 is a section view of the water sprayer in accordance with the first embodiment of the present invention, which shows water within grooved water runners being partially blocked by an inner tubular wall of the rotatable cap under a series adjustment procedure of water-spraying rate.
Figure 8:
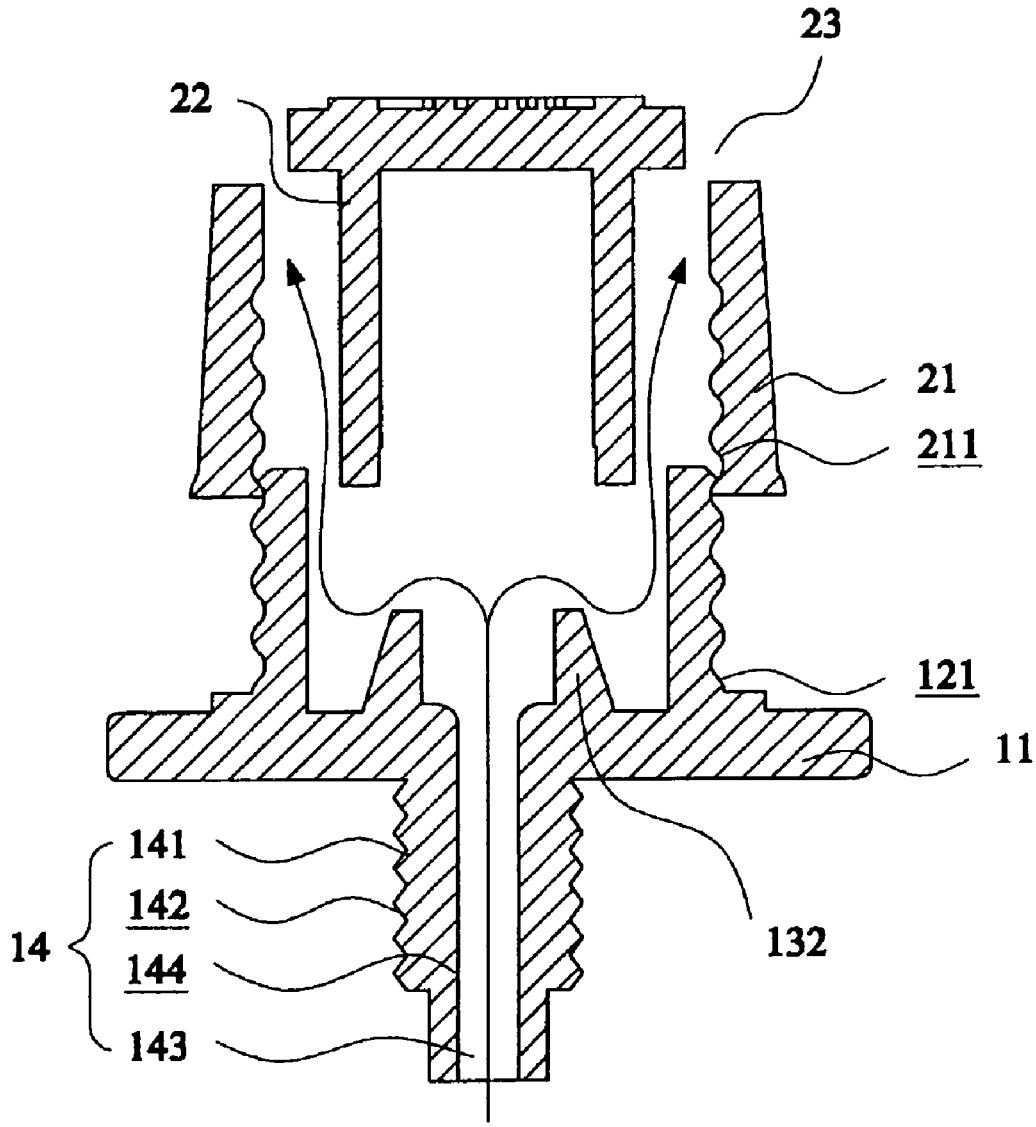
FIG. 8 is a section view of the water sprayer in accordance with the first embodiment of the present invention, which shows water-spraying rate has been adjusted to its greatest limitation.

Please refer to FIG. 4 and FIG. 6 to FIG. 8 presenting a series procedure of the adjustment of water-spraying rate. When the grooved water runners is partially blocked by an inner tubular wall of the rotatable cap, as shown in FIG. 7, water can flow from the source of pressurized water, pass through the inlet runner 143, the central water runner 134 and the grooved water runners 136, and spray out via the water outlets 23.

When the rotatable cap 2 is rotated from a condition that the inner tubular wall 22 of the rotatable cap 2 is fully blocked around the grooved water runners 136 to anther condition that the inner tubular wall 22 of the rotatable cap 2 is approximately blocked less around the grooved water runners 136, i.e., the effective area for water flowing through is increased from zero to the greatest limitation, a rate of water spraying at the water outlets 23 is synchronously increased from zero to its greatest limitation to achieve an adjustment of water-spraying rate.

By the way, please also refer to FIG. 4. People skill in this art can easily realize that due to the outer tubular wall 21 further has the co-ratcheted mechanisms 222 fit for the outer surface 131 of the inner tubular wall 13 of the body 1, the adjustment of water-spraying rate can be achieved in a step-by-step way. Moreover, due to the reason that the adjustment mechanism, i.e., the grooved water runners 136 and the inner tubular wall 22 of the rotatable cap 2, and the passageways of water flow, i.e., the inlet runner 143, the central water runner 134, the grooved water runners 136 and the water outlets 23, are only combined in two simple integrated parts, i.e. the body and the rotatable cap, and the rotatable cap is connected to the body by threading, so that people can easily remove the rotatable cap from the body through rotating the rotatable cap and clean them in convenient ways.

Figure 9:
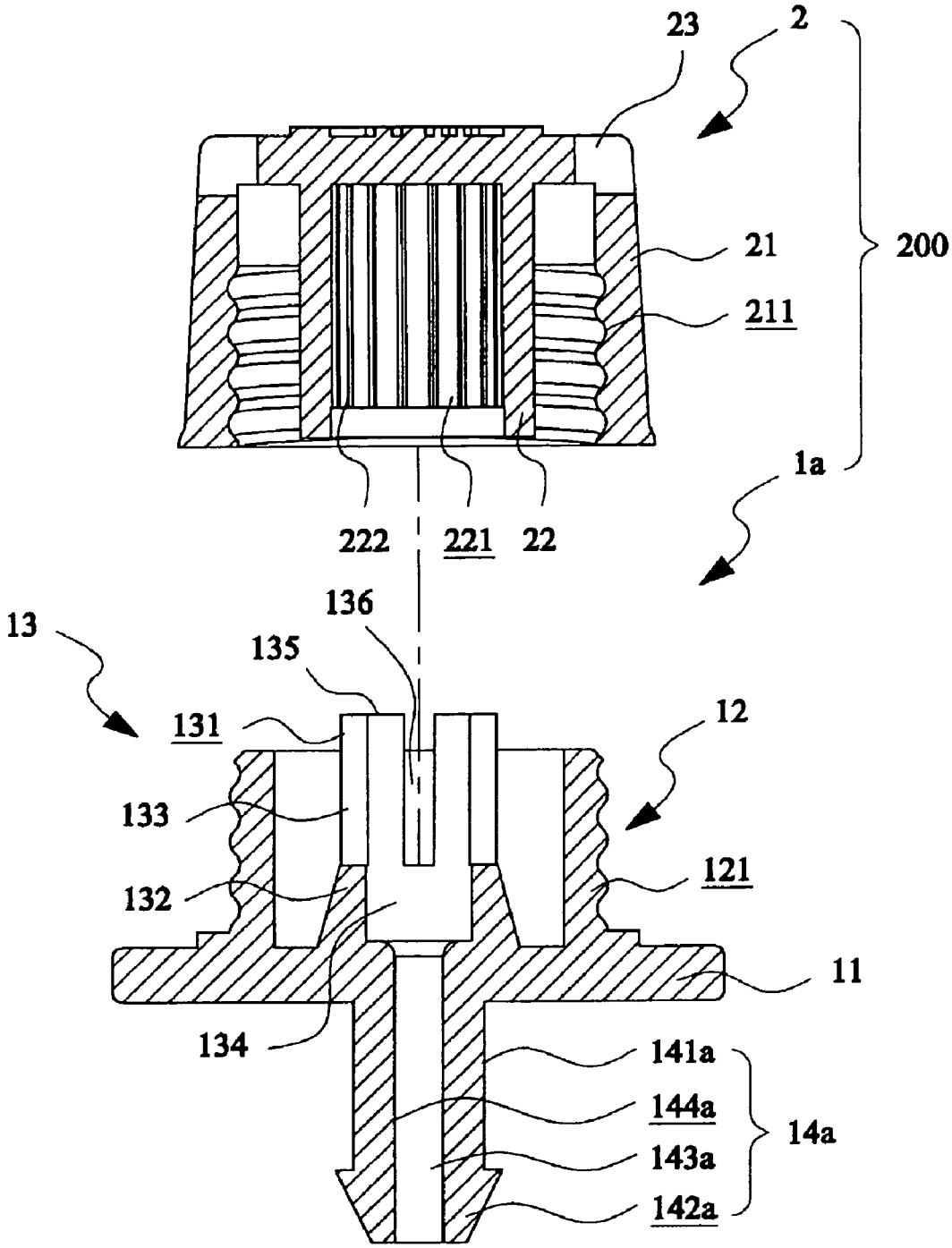
FIG. 9 is a perspective view of the water sprayer in accordance with a second embodiment of the present invention showing an inlet spigot is connected to the tubular stem.

Please refer to FIG. 9, which presents a perspective view of the water sprayer in accordance with a second embodiment of the present invention. In the second embodiment of the present invention, another water sprayer **100*a* is provided, and the most obvious difference between the water sprayer 100 and the water sprayer 100*a* is the inlet portion 14 of the water sprayer 100 is replaced by an inlet portion 14*a*. The inlet portion 14*a* is also constructed in a tubular stem 141*a*, and the tubular stem 141*a* further connects with an inlet spigot 142*a*. An inlet runner 143*a* is also formed in an inner surface 144*a* of the tubular stem 141*a* and communicating with the central water runner 134**.

To make a summary, the water sprayer in accordance with the present invention not only has solved the existed problems effectively but also brings novel, practicable and progressive value meeting the essence of patent to be applied for.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A water sprayer comprising:

a body with a generally cylindrical construction including:

a baseboard provided as a base of the body;

an outer tubular wall with a threaded outer surface circularly extruded from the baseboard;

an inner tubular wall within the outer tubular wall comprising:

a base section within the outer tubular wall circularly extruded from the baseboard coaxial with the outer tubular wall and defining a central runner; and a grooved section with a terminate edge extended from the base section to the terminate edge, constructed with a plurality of slotted grooves extended from the terminate edge toward the base section, and defining a plurality of grooved runner through the inner tubular wall; and an inlet portion being adapted to connect a source of pressurized water, circularly extruded from the baseboard opposite to the inner tubular wall and defining an inlet water runner communicating with the central water runner; and a rotatable cap being adapted to thread on the body and including:

an outer tubular wall with a threaded inner surface fit for and in cooperation with the threaded outer surface of the outer tubular wall of the body for sealing the inner chamber;

an inner tubular wall with an inner surface blocked around the grooved water runners; and a plurality of water outlets formed on the outer tubular wall of the rotatable cap and communicating with the grooved water runners;

wherein when the rotatable cap is rotated from a condition that the inner tubular wall of the rotatable cap is fully blocked around the grooved water runners another condition that the inner tubular wall of the rotatable cap is approximately blocked less around the grooved water runners, a water spraying rate at the water outlets is synchronously increased from zero to its greatest limitation to adjust the water spraying rate.

2. The water sprayer as claimed in claim 1, further comprising a plurality of circularly distributed co-ratcheted mechanisms fit for the outer surface of the inner tubular wall of the body, formed in the inner surface of the inner tubular wall of the rotatable cap for adjusting the water spraying rate in a step-by-step manner.

3. The water sprayer as claimed in claim 1, wherein the inlet portion of the body is provided in a tubular stem with the inlet water runner formed in an inner surface of the tubular stem.

4. The water sprayer as claimed in claim 3, wherein the tubular stem is provided with a threaded outer surface.

5. The water sprayer as claimed in claim 3, wherein an inlet spigot is further connected to the tubular stem.

* * * * *